US009908002B2

(12) United States Patent
Robertson

(10) Patent No.: US 9,908,002 B2
(45) Date of Patent: Mar. 6, 2018

(54) PORTABLE, COLLAPSIBLE ERGONOMIC TIPPING CHAIR

(71) Applicant: James Craig Robertson, Williamstown, MA (US)

(72) Inventor: James Craig Robertson, Williamstown, MA (US)

( * ) Notice: Subject to any disclaimer, the term of this patent is extended or adjusted under 35 U.S.C. 154(b) by 0 days.

(21) Appl. No.: 15/036,950

(22) PCT Filed: Nov. 20, 2015

(86) PCT No.: PCT/US2015/061865
§ 371 (c)(1),
(2) Date: May 16, 2016

(87) PCT Pub. No.: WO2016/081840
PCT Pub. Date: May 26, 2016

(65) Prior Publication Data

US 2017/0252608 A1 Sep. 7, 2017

Related U.S. Application Data

(60) Provisional application No. 62/082,877, filed on Nov. 21, 2014.

(51) Int. Cl.
*A47C 1/00* (2006.01)
*A63B 21/00* (2006.01)
(Continued)

(52) U.S. Cl.
CPC ..... *A63B 26/00* (2013.01); *A47C 1/00* (2013.01); *A63B 21/0023* (2013.01);
(Continued)

(58) Field of Classification Search
CPC ..... A47C 1/00; A47C 9/002; A63B 21/0004; A63B 21/00058; A63B 21/00069; A63B 21/00072; A63B 21/00178; A63B 21/00181; A63B 21/00185; A63B 21/002; A63B 21/0023; A63B 21/0615; A63B 21/0616; A63B 21/0617; A63B 21/065;
(Continued)

(56) References Cited

U.S. PATENT DOCUMENTS 4,971,040 A * 11/1990 Gillotti ..... A61G 15/007 5/620
5,718,659 A * 2/1998 Van Straaten ..... A63B 21/04 482/130

(Continued)

*Primary Examiner* — Andrew S Lo
*Assistant Examiner* — Gary D Urbiel Goldner
(74) *Attorney, Agent, or Firm* — Malcolm J. Chisholm, Jr.

(57) ABSTRACT

A tipping chair (10) includes a main strut (12),a pivot seat (34) on the main strut (12), a pivot slot (18) defined the main strut (12) and a pivot strut (24) pivotally secured within the pivot slot (18). Pivoting a prop end (28) of the pivot strut (24) out of the pivot slot (18) of the main strut (12) backward toward a bottom end (14)of the main strut (12) causes a seat end (26) of the pivot strut (24) to raise the pivot seat(34) , and the seat end (26) becomes secured to a latch (42) on a brace surface (40) opposed to a seating surface (38) of the pivot seat (34) to postion the chair (10) in a seated.configuration. Reversing the process returns the chair (10) to a flat, stored configuration to be optionally stored as wall art.

19 Claims, 11 Drawing Sheets

(51) Int. Cl.

| | |
|---|---|
| ***A63B 21/002*** | (2006.01) |
| ***A63B 21/068*** | (2006.01) |
| ***A63B 21/16*** | (2006.01) |
| ***A63B 23/02*** | (2006.01) |
| ***A63B 23/04*** | (2006.01) |
| ***A63B 26/00*** | (2006.01) |
| ***A63B 71/00*** | (2006.01) |

(52) U.S. Cl.
CPC ..... *A63B 21/068* (2013.01); *A63B 21/169* (2015.10); *A63B 21/4029* (2015.10); *A63B 21/4047* (2015.10); *A63B 23/0205* (2013.01); *A63B 23/04* (2013.01); *A63B 71/0036* (2013.01); *A63B 2208/0233* (2013.01); *A63B 2209/00* (2013.01); *A63B 2209/10* (2013.01); *A63B 2210/50* (2013.01); *A63B 2225/09* (2013.01)

(58) Field of Classification Search
CPC ..... A63B 21/068; A63B 21/08; A63B 21/15; A63B 21/159; A63B 21/16; A63B 21/1609; A63B 21/169; A63B 21/4023; A63B 21/4027; A63B 21/4029; A63B 21/4031; A63B 21/4039; A63B 21/4041; A63B 21/4043; A63B 21/4045; A63B 21/4047; A63B 21/4049; A63B 23/02; A63B 23/0205; A63B 23/0211; A63B 23/0216; A63B 23/0222; A63B 23/035; A63B 23/03516; A63B 23/03525; A63B 23/04; A63B 23/0405; A63B 23/0482; A63B 23/0494; A63B 23/08; A63B 23/085; A63B 2023/0411; A63B 26/00; A63B 26/003; A63B 69/0057; A63B 69/0059; A63B 71/0036; A63B 2208/0228; A63B 2208/0233; A63B 2210/00; A63B 2210/02; A63B 2210/50; A63B 2210/58; A63B 2225/09; A63B 2225/093
See application file for complete search history.

(56) References Cited

U.S. PATENT DOCUMENTS

| | | | | |
|---|---|---|---|---|
| 7,144,080 | B2 * | 12/2006 | Lloyd | A47C 9/005 297/195.11 |
| 7,998,039 | B1 * | 8/2011 | Wallach | A63B 21/023 482/121 |
| 2002/0171281 | A1 * | 11/2002 | Cochran | A61G 15/007 297/423.11 |
| 2005/0143226 | A1 * | 6/2005 | Heidecke | A63B 21/0053 482/62 |
| 2007/0037677 | A1 * | 2/2007 | Splane, Jr. | A63B 21/4047 482/121 |
| 2007/0037679 | A1 * | 2/2007 | Geeting | A63B 21/0004 482/130 |
| 2007/0129225 | A1 * | 6/2007 | Hammer | A63B 21/0552 482/129 |
| 2007/0138850 | A1 * | 6/2007 | Oettinger | A47C 3/029 297/271.5 |
| 2009/0001788 | A1 * | 1/2009 | Lenz | A47C 9/002 297/217.4 |
| 2009/0134674 | A1 * | 5/2009 | Deck | A47C 9/002 297/118 |
| 2009/0170673 | A1 * | 7/2009 | Barretta | A63B 21/00047 482/130 |
| 2009/0284064 | A1 * | 11/2009 | Maynard, Jr. | A47C 9/005 297/423.12 |
| 2010/0069801 | A1 * | 3/2010 | Tsai | A63B 21/4047 601/134 |
| 2013/0306831 | A1 * | 11/2013 | Keen | A47C 7/506 248/599 |
| 2014/0011644 | A1 * | 1/2014 | Ho | A63B 21/068 482/96 |

* cited by examiner

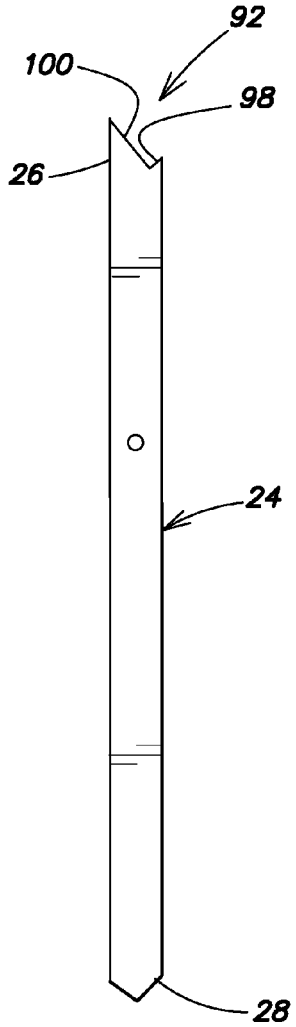
FIG. 6
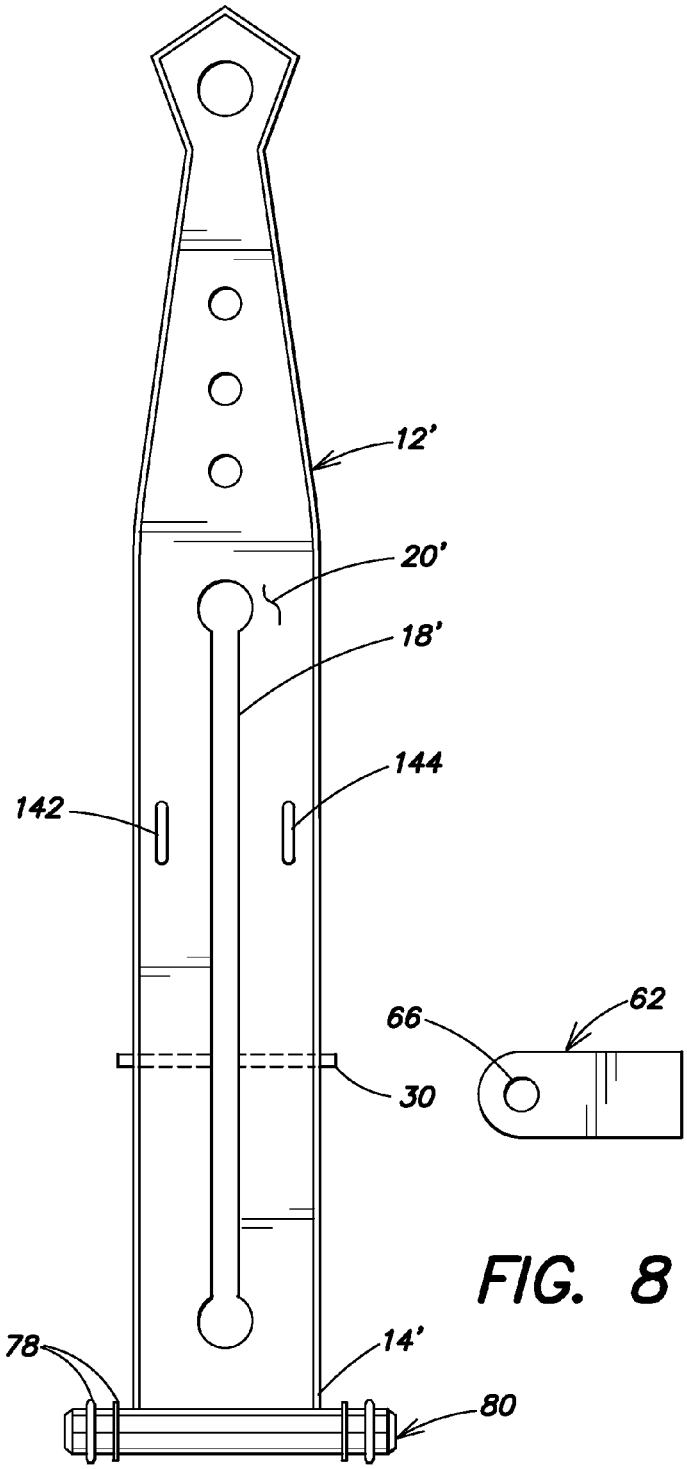
FIG. 8
FIG. 7

PORTABLE, COLLAPSIBLE ERGONOMIC TIPPING CHAIR

CROSS-REFERENCE TO RELATED APPLICATION

This application claims the benefit of U.S. Provisional Patent Application Ser. No. 62/082,877 that was filed on 21 Nov. 2014 entitled "CHAIR".

TECHNICAL FIELD

This disclosure relates to ergonomic chairs, and in particular relates to a portable, collapsible ergonomic tipping chair that enables users of the chair to gently exercise their legs and abdominal muscles by tipping the chair forward and back while seated in the chair and that also imposes a slouch-proof correct seated posture on users seated on the tipping chair.

BACKGROUND ART

It is well known that people currently spend a great deal of time in stationary positions, such as being seated during work hours, while traveling to and from work, while eating, while enjoying television and while socializing indoors. Modern medicine is informing such persons that extended stationary positions may give rise to moderate to severe health concerns. For example, such seated office workers may gain excess weight, be subject to back problems due to comfortable rather than upright seating postures, and generally experience a decline in muscle tone. Many efforts have been undertaken to increase activity levels of such persons, including for example intervals for exercise of skeletal muscles, using stairs instead of elevators, using treadmill desks enabling very slow walking while working, and using active chairs.

"Active chairs" are a category of chairs that facilitates differing postures and limited movement of legs of persons using such chairs. Many can be seen in in a standard internet "GOOGLE SEARCH" of the phrase "active chairs" and then selecting the "images" uncovered in the search. A well-known example of an active chair is available under the product name "AERIS MUVMAN" from the AERIS Company of Germany, at http://www.aeris.de/en/muvman/. The Aeris Muvman includes a small seat supported on top of a post extending from a circular base that is wider than the seat. Another active chair is available from the same AERIS Company, and is entitled "Aeris Swopper" which has an adjustable length post sticking out of a partial circular base with a cushioned, spring-loaded seat, wherein the vertical post enables limited tilting. It is also available at http://www.swopper.com/. Yet another modern active seat is available under the product name "Focal Mogo", that is available from the FOCAL Company at http://www.focaluprightfurniture.com/. The Focal Mogo is simply a hard, small seat dimensioned to support only a user's buttocks, and the seat is attached to an eighteen-inch post that has semi-spherical rubber or plastic form that is secured to a lower end of the post is as wide as the post to minimize any sliding of the post during use.

While these and other known active chairs provide limited opportunity for movement by a user, most are focused upon use by office workers wherein there is typically a substantial amount of space for leaving the active chairs within the office. Further, such office active chairs invariably are designed to be in a style in harmony with brightly lit office spaces having file cabinets, untold numbers of pulsing computers and related office machinery frequently located in broken up office cubicles having an overall "industrial" appearance. In other words, none are designed to blend in with a comfortable and efficient home environment.

Moreover, it is increasingly popular, pleasing and economically beneficial to minimize "clutter" and excessive furniture in many modern residences. Indeed, both rural and urban living quarters are experiencing the many benefits of the popular "TINY HOUSE" movement, as discussed on the internet at many locations, such as at: http://tinyhouseblog.com/. None of the known active chairs are designed to comfortably fit within such intimate and carefully planned living environments. Consequently, there is a need for an active chair that provides significant health benefits to a user, that can be collapsed into an efficient and attractive storage configuration, that provides design harmony with the environment of its use, that can be easily opened up from storage for use indoors, and that can be carried by the user to an outdoor activity.

SUMMARY OF THE DISCLOSURE

The present disclosure is a portable, collapsible ergonomic tipping chair that enables a user of the chair to gently exercise their leg and abdominal muscles by tipping the chair forward and back while seated in the chair. The chair includes a main strut having a bottom end and an opposed top end. The main strut also defines a pivot slot that extends from adjacent the bottom end toward the top end of the main strut. An entire length of the pivot slot passes completely through the main strut from a front surface through a back surface of the strut. A pivot strut includes a seat end and an opposed prop end. The pivot strut is pivotally secured within the pivot slot by a pivot strut axle that is secured between the main strut and a mid-section of the pivot strut. The pivot axle enables the pivot strut to pivot back-and-forth from a first position wherein the pivot strut is completely within the pivot slot and the seat end of the pivot strut is adjacent the bottom end of the main strut, to a second position wherein the seat end of the pivot strut extends away from the front surface of the main strut and the prop end of the pivot strut extends away from the back surface of the main strut.

A pivot seat is pivotally secured to the main strut by a seat hinge. The pivot seat includes a seating surface and an opposed brace surface. The brace surface includes a latch for engaging and disengaging the seat end of the pivot strut from the latch. The seat hinge is positioned on the front surface of the main strut between the pivot strut axle and the top end of the main strut. The seat hinge enables the pivot seat to pivot back-and-forth from a first position wherein the brace surface is aligned adjacent the front surface of the main strut to a second position wherein the brace surface of the pivot seat is aligned about perpendicular to the front surface of the main strut. Whenever the pivot strut is in the first position and the brace surface of the pivot seat is aligned adjacent the front surface of the main strut, the tipping chair is in a stored configuration. Whenever the pivot strut is in the second position so that the seat end of the pivot strut is pivoted out of the pivot slot to contact and position the brace surface of the pivot seat about perpendicular to the front surface of the main strut, to position the seat end of the pivot strut detachably secured to the latch in the brace surface of the pivot seat, and to position the prop end of the pivot strut away from the back surface of the main strut, the tipping chair is in a seating configuration.

In another aspect of the portable, collapsible ergonomic tipping chair, whenever the chair is in the seated configuration, the prop end of the pivot strut and the bottom end of the main strut are contacting a chair support surface upon which the tipping chair is supported and the chair support surface is about parallel to a plane perpendicular to a direction of the force of gravity. In the seated configuration, a distance between the bottom end of the main strut contacting the chair support surface and the prop end of the pivot strut contacting the chair support surface is dimensioned so that the main strut is in a main strut seated alignment between the back surface of the main strut and the prop end of the pivot strut contacting the chair support surface that is between about sixty-five degrees and about eighty-five degrees. Additionally, the pivot seat is also supported by the seat end of the pivot strut so that the pivot seat is in a pivot seat seated alignment between the seating surface of the pivot seat and a portion of the front surface of the main strut above the seat hinge that is between about eighty-five degrees and about one-hundred degrees. (For purposes herein, "above" is in a direction toward the top end of the main strut. Also for purposes herein the word "about" is to mean plus or minus fifteen percent) Also, a leading edge of the pivot seat extends a distance away from the front surface of the main strut that is only about one-half of a distance between the seat hinge and the bottom end of the main strut contacting the chair support surface. Because the seat surface extends only a short distance from the front surface of the main strut, the tipping chair necessarily imposes a slouch-proof correct seated posture on a user seated on the seating surface of the pivot seat. In other words, to remain seated on the seat surface and not slide forward off of the seat surface, the user's back must be leaning upward at a near ninety degree angle relative to a plane parallel to the seat surface of the pivot seat. This eliminates any possible slouch in the alignment of the user's back leading to a correct posture.

In a further aspect of the portable, collapsible ergonomic tipping chair, the seat hinge may be made of any seat hinge means for pivotally securing the pivot seat to the front surface of the main strut, such as traditional metal types of door hinges, etc. More specifically, the seat hinge means may include at least a first coupling and a second coupling that are secured to and extend away from the front surface of the main strut, wherein each coupling defines a coupling bore passing through the couplings. At least a first notch and a second notch are defined within a contact edge of the pivot seat. The contact edge is opposed to the leading edge, and is positioned adjacent the front surface of the main strut when the tipping chair is in the seated configuration. The at least first and second notches are configured to receive the first and second couplings within the notches. A hinge bore passes through the contact edge of the pivot seat and through the first and second notches. A hinge pin is configured to pass through the hinge bore, to pass through the first and second notches and the first and second coupling bores of the first and second couplings within the first and second notches to thereby pivotally secure the pivot seat to the front surface of the main strut.

In an additional embodiment of the portable, collapsible ergonomic tipping chair, a distance between the pivot strut axle and the seat end of the pivot strut is between about sixty percent and about seventy percent of a distance between the pivot strut axle and the prop end of the pivot strut.

In a further aspect of the disclosure, the tipping chair includes friction enhancing means secured to the bottom end of the main strut for increasing friction between the bottom end and the chair support surface upon which the tipping chair is supported. In particular embodiments, the friction enhancing means include friction enhancing members secured to the bottom end of the main strut and configured to contact the surface upon which the tipping chair is supported. The friction enhancing members may be selected from the group consisting of rubber, compounds including rubber, polymers, engineered polymers, asbestos containing and non-asbestos containing friction materials, organic friction based compounds, and combinations thereof.

In a different aspect of the portable, collapsible ergonomic tipping chair, the bottom end of the main strut includes a foot secured to the bottom end, wherein the foot extends beyond at least one of opposed side edges of the bottom end of the main strut. Also, the foot is positioned to contact the surface upon which the tipping chair is supported, and the foot defines at least a partial cylindrical outer surface contacting the surface upon which the tipping chair is supported. The at least partial cylindrical shape facilitates tipping of the chair. The foot may also include at least one friction enhancing member secured between the cylindrical outer surface and the surface upon which the tipping chair is supported. For example, the friction enhancing member may include at least one flexible O-ring secured within cylindrical grooves defined in an outer circumference of the foot.

In another aspect of the portable, collapsible ergonomic tipping chair, the chair includes a latch means on the brace surface of the pivot seat for engaging and disengaging the seat end of the pivot strut from the latch. The latch means may be any latch commonly known that can detachably secure a support strut to a flat surface, such as a metal hook on the brace surface and a metal eye-loop on the seat end of the pivot strut, a "hook-and-loop" (known commonly as "VELCRO") pad on the brace surface and a cooperative hook-and-loop extension from the seat end dimensioned to contact the pad to secure the seat end to the latch, etc. In a particular form of the latch means at the brace surface of the pivot chair includes a latch lip and a latch bore extending from the latch lip under the brace surface in a direction away from the brace surface of the pivot seat. The seat end of the pivot strut defines a slotted birds-mouth tip configured so that the slot of the birds-mouth engages the latch lip, and an upper portion of the birds-mouth passes into the latch bore beyond the latch lip. A lower portion of the birds-mouth extends beyond the latch lip toward a leading edge of the pivot seat, so that a force applied to the seating surface of the pivot seat and in a direction perpendicular to the seating surface and toward the bottom end of the main strut locks the slotted birds-mouth tip between the latch lip and the latch bore. Also, an opposed force applied to the brace surface in a direction away from the bottom end of the main strut pivots the pivot seat away from the seat end of the pivot strut thereby unlocking the slotted birds-mouth tip of the seat end of the pivot strut from the latch.

In a further aspect of the tipping chair, the latch means at the brace surface of the pivot chair further comprises a dovetail latch that includes a latch bore extending under the brace surface and includes a mortise cavity extending under the brace surface from the latch bore in a direction toward a leading edge of the pivot seat. Additionally, the seat end of the pivot strut includes a tenon projection configured so that the tenon projection slides into the mortise cavity to secure the seat end of the pivot strut against removal from the dovetail latch by a force on the pivot seat in the direction the top end of the main strut.

In yet another embodiment of the tipping chair, the prop end of the pivot strut includes an expansion shoe pivotally secured to the prop end, and configured for contacting the support surface upon which the tipping chair is supported. The expansion shoe defines a cross-sectional surface area parallel to a plane perpendicular to a longitudinal axis of the pivot strut that is at least between about one hundred percent and about three hundred percent greater than a cross-sectional surface area of the pivot strut. The pivot strut cross-sectional area is parallel to a plane perpendicular to a longitudinal axis of the pivot strut. Whenever the tipping chair is positioned in the stored configuration, the pivot strut is aligned within the pivot slot to be flush within the slot, while the expansion shoe pivots away from the pivot slot to be adjacent the back surface of the main strut.

In another aspect of the portable, collapsible ergonomic tipping chair, the chair includes an expansion pivot foot secured to the bottom end of the main strut for contacting the support surface upon which the tipping chair is supported. The expansion pivot foot includes a base defining a surface area parallel to a plane perpendicular to a longitudinal axis of the main strut that is at least between about three hundred percent and about six hundred percent greater than a cross-sectional surface area of the bottom end of the main strut, which bottom end of the main strut cross-sectional area is parallel to a plane perpendicular to a longitudinal axis of the main strut. The expansion pivot foot defines a pivot trough above the base, and the trough includes a pivot dowel pivotally secured within the pivot trough and secured to the bottom end of the main strut. This permits pivoting of the main strut while the base remains stationery relative to the support surface upon which the tipping chair is supported.

In yet another embodiment of the portable, collapsible ergonomic tipping chair, a foot is secured to the bottom end of the main strut. The foot extends beyond at least one of opposed side edges of the bottom end of the main strut, and the foot is positioned to contact the support surface upon which the tipping chair is supported. The foot defines at least a partial cylindrical outer surface contacting the surface upon which the tipping chair is supported to facilitate tipping of the chair. The foot also includes at least one detachable expansion shoe having a base defining a surface area parallel to a plane perpendicular to a longitudinal axis of the main strut that is at least between about one hundred percent and about two hundred percent greater than a surface area of the portion of the partial cylindrical outer surface of the foot contacting the support surface. The at least one detachable expansion shoe defines a pivot bore configured for being pivotally secured to at least one of the side edges of the foot.

In a further aspect of the ergonomic tipping chair, the main strut defines a wall-mount throughbore passing through an upper portion of the main strut. Additionally, opposed side-edges of the main strut define curved edges, or curved edges with straight edges, wherein the opposed side-edges are configured in mirror-image association with each other for an attractive aesthetic appearance. Use of several of the tipping chairs that are in the stored configuration supported by wall mounts passing through the wall-mount throughbores provides a unique form of wall art, wherein the tipping chairs have the same or differing curved, mirror-image side edges, and wherein the tipping chairs are made of wood exhibiting attractive grain and color patterns. For example, in a very small room, several of the tipping chairs may be attractively stored by their wall-mount throughbores. Only a number of the chairs would be repositioned to their seating configurations to suit the number of persons in the room. The tipping chairs can then be positioned back into their stored configurations and replaced onto the wall mounts after use to efficiently and attractively manage the room.

In a further aspect of the portable, collapsible ergonomic tipping chair, the pivot slot defines a first finger-grasp throughbore at a bottom end of the slot beyond the seat end of the pivot strut, and a second finger-grasp throughbore at an opposed top end of the slot beyond the prop end of the pivot strut. The finger-grasp throughbores define voids facilitating movement of the pivot strut out of and into the pivot slot. The tipping chair may further include a flexible carrying strap having a first dowel segment at a first end of the strap and a second dowel segment at an opposed second end of the strap. The first and second dowel segments are dimensioned to have axial lengths longer than longest diameters of the finger-grasp throughbores. The first and second dowel segments are also dimensioned to have diameters shorter than the diameters of the finger-grasp throughbores. Additionally, the first end of the strap is secured to a mid-section of the first dowel segment and the second end of the strap is secured to a mid-section of the second dowel segment.

For efficient portability of the tipping chair, the relative dimensions of the first and second dowel segments permit the dowel segments to be moved longitudinally through the first and second finger-grasp throughbores. Upon application of a lifting force on the strap and with the strap ends being positioned in the mid-sections of the dowel segments, the dowel segments move to be positioned perpendicular to diameters of finger-grasp throughbores and the dowel segments extend beyond the finger-grasp throughbores to rest against a surface of the main strut on opposed sides of the finger-grasp holes. In this disposition of the dowel segments, the strap may be used to support the tipping chair in the stored configuration, such as over the shoulder of a user, until the user rotates the dowel segments to remove them from the finger-grasp throughbores to thereby remove the carrying strap from the tipping chair. The dowel segments may also include rubber-like O-rings around distal ends of the dowel segments to enhance friction between the dowel segment and the surface of the main strut, and to avoid scratching or other damage to the front or back surfaces.

It is to be understood that the present disclosure also includes an inventive method of transitioning the portable, collapsible ergonomic tipping chair from the stored configuration to the seating configuration. The method includes pivoting the prop end of the pivot strut away from the back surface of the main strut while simultaneously pivoting the seat end of the pivot strut away from the front surface of the main strut; raising the leading edge of the pivot seat away from adjacent the front surface of the main strut by the pivoting of the seat end of the pivot strut so that the seat end of the pivot strut contacts and raises the leading edge of the pivot seat to align the seating surface of the pivot seat to be about perpendicular to the front surface of the main strut; moving the seat end of the pivot strut along the brace surface of the pivot seat from the leading edge toward the contact edge of the pivot seat; positioning the prop end of the pivot strut so that a distance between the bottom end of the main strut contacting the chair support surface and the prop end contacting the chair support surface is dimensioned so that the main strut is in a main strut seated alignment between the back surface of the main strut and the prop end of the pivot strut contacting the chair support surface that is between about sixty-five degrees and about eighty-five degrees; and securing the seat end of the pivot strut to the latch on the brace surface of the pivot seat to secure the tipping chair in the seated configuration.

An additional method of using the tipping chair includes transitioning the chair from the seated configuration to the stored configuration, by removing the seat end of the pivot strut from the latch; then pivoting the seat end of the pivot strut toward the bottom end of the main strut and into the pivot slot; and permitting the leading edge of the pivot seat to pivot toward the bottom end of and front surface of the main strut until the brace surface of the pivot seat is aligned adjacent the front surface of the main strut near the bottom end of the main strut to thereby secure the tipping chair in the stored configuration.

Accordingly, it is a primary object of the present disclosure to provide a portable, collapsible ergonomic tipping chair that overcomes deficiencies of the prior art.

It is a more specific object to a provide a portable, collapsible ergonomic tipping chair that minimizes manufacturing costs, provides an aesthetically pleasing piece of fine furniture, that transitions from a health-enhancing seating configuration to a flat, wall-art stored configuration, and that is easily portable from an indoor firm support surface environment, to an outdoor soft support surface recreational type of environment.

BRIEF DESCRIPTION OF THE FIGURES

FIG. 6 is a side plan view of a pivot strut of the portable, collapsible ergonomic tipping chair.

FIG. 7 is a front plan view of a main strut of a portable, collapsible ergonomic tipping chair and showing a pivot slot, first and second couplings of a seat hinge, a pivot strut axle within a pivot strut axle throughbore, and a foot having friction enhancing members secured to a bottom of the main strut.

FIG. 8 is a sectional side plan view of a first coupling of a seat hinge of a portable, collapsible ergonomic tipping chair and showing a coupling bore within the coupling.

DETAILED DESCRIPTION OF THE PREFERRED EMBODIMENTS

Figure 1:
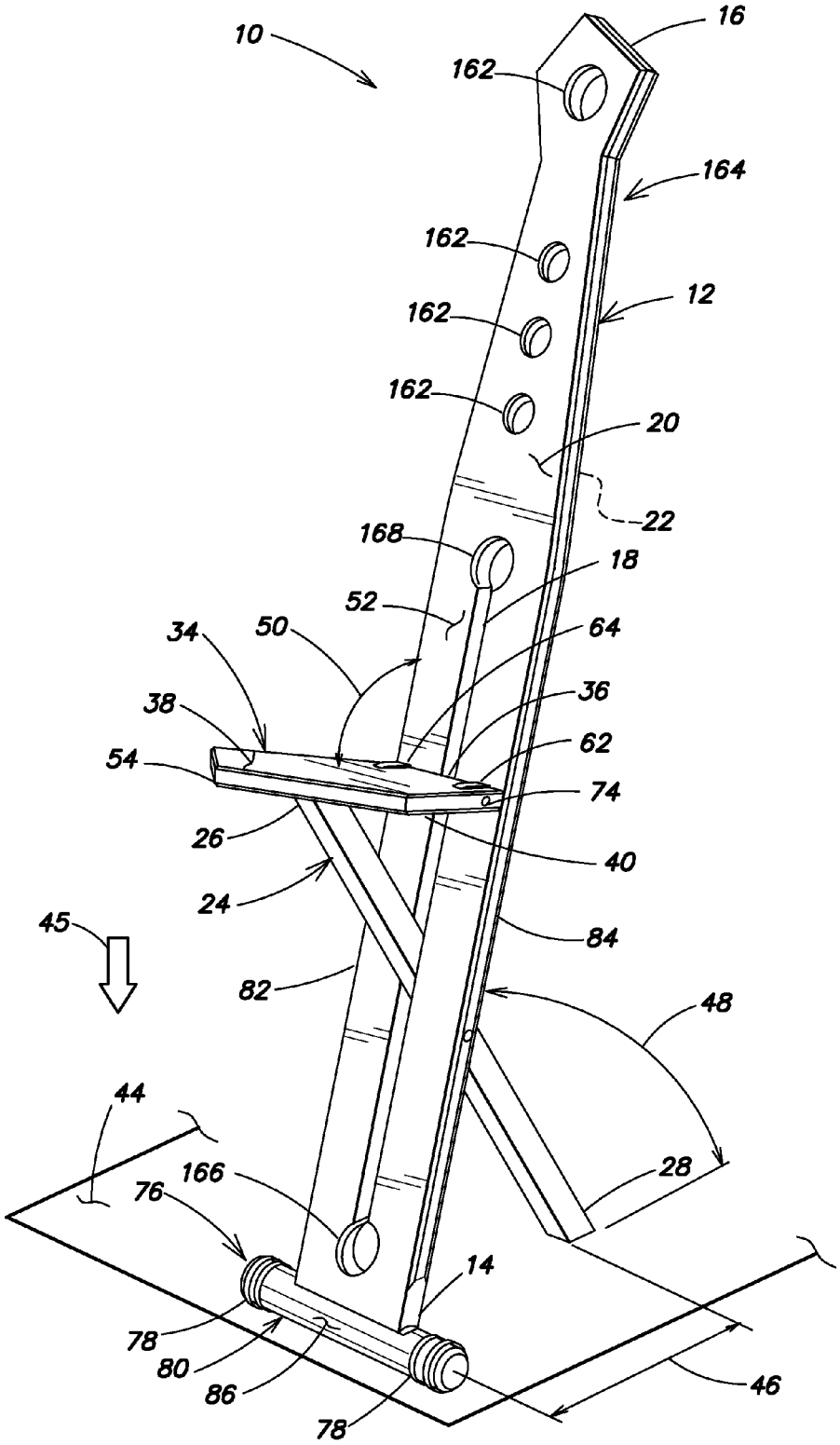
FIG. 1 is a side perspective view of a portable, collapsible ergonomic tipping chair constructed in accordance with the present disclosure and showing the chair in a seating configuration.

Referring to the drawings in detail a portable, collapsible ergonomic tipping chair of the present disclosure is shown best in FIGS. 1-5 and is generally designated by the reference numeral 10. The tipping chair 10 includes a main strut 12 having a bottom end 14 and an opposed top end 16. The main strut 12 also defines a pivot slot 18 that extends from adjacent the bottom end 14 toward the top end 16 of the main strut 12. An entire length of the pivot slot 18 passes completely through the main strut 12 from a front surface 20 through a back surface 22 of the strut. A pivot strut 24 includes a seat end 26 and an opposed prop end 28. The pivot strut 24 is pivotally secured within the pivot slot 18 by a pivot strut axle 30 that is secured between the main strut 12 and a mid-section 32 of the pivot strut 24. The pivot strut axle 30 enables the pivot strut 24 to pivot back-and-forth from a first position (shown in FIGS. 2 and 3) wherein the pivot strut 24 is completely within the pivot slot 18 and the seat end 26 of the pivot strut 24 is adjacent the bottom end 14 of the main strut 12, to a second position (shown in FIGS. 1 and 4) wherein the seat end 26 of the pivot strut 24 extends away from the front surface 20 of the main strut 12 and the prop end 28 of the pivot strut 24 extends away from the back surface 22 of the main strut 12.

A pivot seat 34 is pivotally secured to the main strut 12 by a seat hinge 36. The pivot seat 34 includes a seating surface 38 and an opposed brace surface 40. The brace surface 40 includes a latch 42 for engaging and disengaging the seat end 26 of the pivot strut 24 from the latch 42. The seat hinge 36 is positioned on the front surface 20 of the main strut 12 between the pivot strut axle 30 and the top end 16 of the main strut 12. The seat hinge 36 enables the pivot seat 24 to pivot back-and-forth from a first position (shown best in FIGS. 2 and 3) wherein the brace surface 40 is aligned adjacent the front surface 20 of the main strut 12 to a second position (shown best in FIGS. 1 and 4) wherein the brace surface 40 of the pivot seat 34 is aligned about perpendicular to the front surface 20 of the main strut 12.

Figure 2:
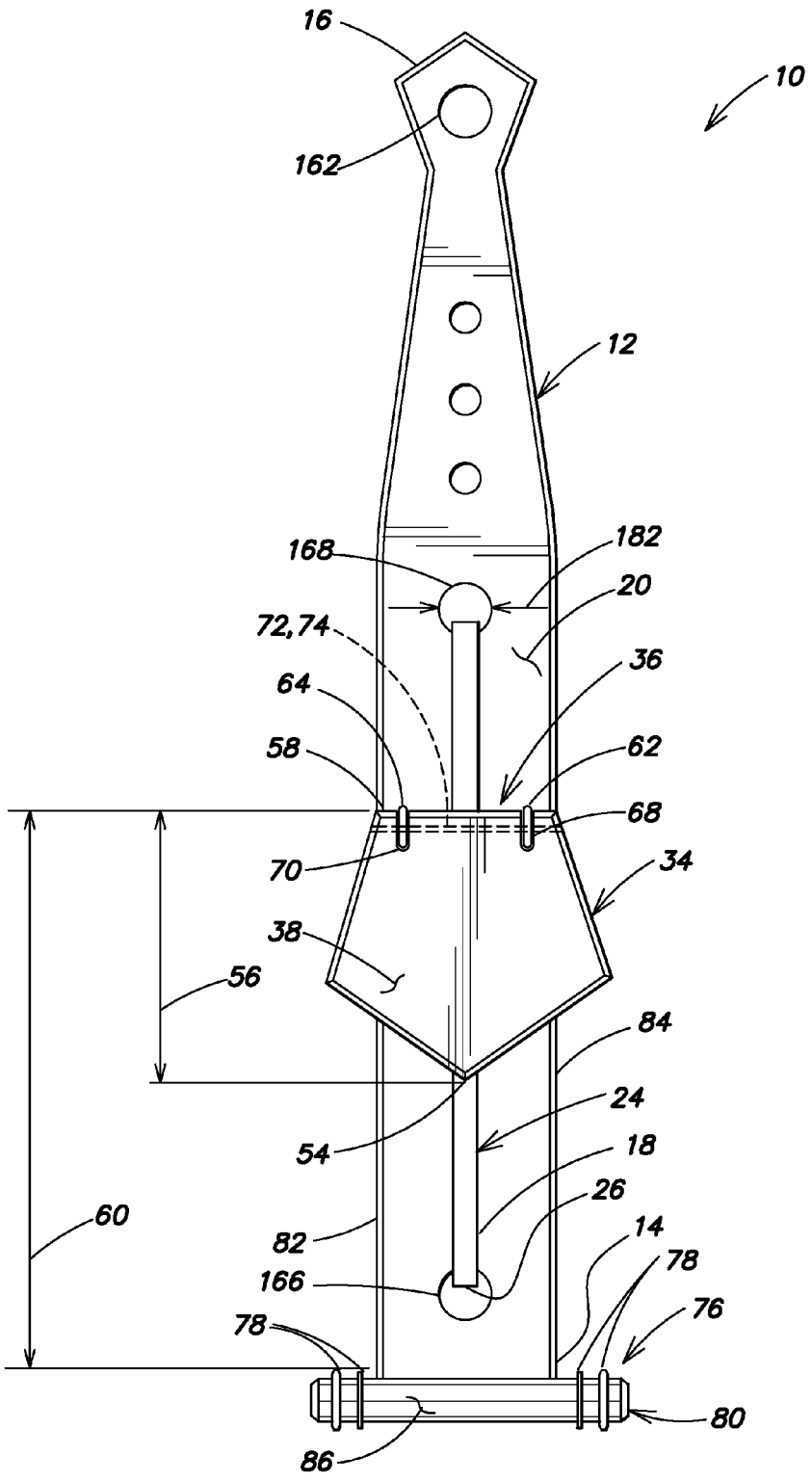
FIG. 2 is a front plan view of the FIG. 1 portable, collapsible ergonomic tipping chair, and showing the chair in a stored configuration.

Whenever the pivot strut 24 is in the FIG. 2 first position and the brace surface 40 of the pivot seat 34 is aligned adjacent the front surface 20 of the main strut 12, the tipping chair 10 is characterized herein as being in a stored configuration. Whenever the pivot strut 24 is in the FIG. 1 second position so that the seat end 26 of the pivot strut 24 is pivoted out of the pivot slot 18 to contact and position the brace surface 40 of the pivot seat 34 about perpendicular to the front surface 20 of the main strut 12, to position the seat end 26 of the pivot strut 24 detachably secured to the latch 42 in the brace surface 40 of the pivot seat 34, and to position the prop end 28 of the pivot strut 24 away from the back surface 22 of the main strut 12, the tipping chair 10 is characterized herein as being in a seating configuration.

In another aspect of the portable, collapsible ergonomic tipping chair 10, whenever the chair is in the FIG. 1 seated configuration, the prop end 28 of the pivot strut 24 and the bottom end 14 of the main strut 12 are contacting a chair support surface 44 upon which the tipping chair 10 is supported, and the chair support surface 44 is about parallel to a plane perpendicular to a direction of the force of gravity (designated by the arrow in FIG. 1 with reference numeral 45). In this FIG. 1 seated configuration, a first distance 46 between the bottom end 14 of the main strut 12 contacting the chair support surface 44 and the prop end 28 of the pivot strut 24 contacting the chair support surface 44 is dimensioned so that the main strut 12 is in a main strut seated alignment 48 between the back surface 22 of the main strut 12 and the prop end 28 of the pivot strut 24 contacting the chair support surface 44 that is between about sixty-five degrees and about eighty-five degrees. Additionally, the pivot seat 34 is also supported by the seat end 26 of the pivot strut 24 so that the pivot seat 34 is in a pivot seat seated alignment 50 between the seating surface 38 of the pivot seat 34 and a portion 52 of the front surface 20 of the main strut 12 above the seat hinge 36 that is between about eighty-five degrees and about one-hundred degrees.

(For purposes herein, "above" is in a direction toward the top end of the main strut. Also, for purposes herein, the word "about" is to mean plus or minus fifteen percent.)

Also, a leading edge 54 of the pivot seat 34 extends a second distance 56 away from a contact edge 58 of the pivot seat 34 (as shown in FIG. 2) (or from the front surface 20 of the main strut 12, as shown in FIG. 1) that is only about one-half of a third distance 60 between the seat hinge 36 and the bottom end 14 of the main strut 12 contacting the chair support surface 44. Therefore, the seat surface 38 is quite shallow compared to known seats having adjacent vertical back supports. (It is well known that an average height of a seat is eighteen inches. Therefore, the pivot seat 34 has an approximate extension from the back-supporting main strut 12 of about nine inches.) Consequently, the tipping chair 10 necessarily imposes a slouch-proof correct seated posture on a user seated on the seating surface 38 of the pivot seat 34. In other words, to remain seated on the seat surface 38 and not slide forward off of the leading edge 54 of the seat surface 36, the user's back must be leaning upward at a near ninety degree angle relative to a plane parallel to the seat surface 38 of the pivot seat 34. This eliminates any possible slouch in an alignment of the user's back (not shown) leading to a correct posture.

Figure 9:
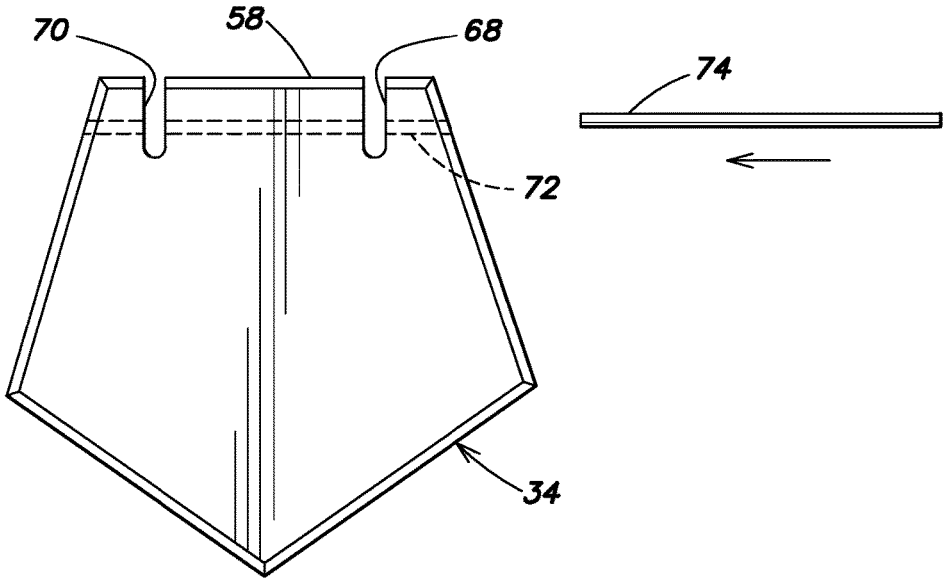
FIG. 9 is a top plan view of a pivot seat of a portable, collapsible ergonomic tipping chair and showing a first notch and a second notch defined within a contact edge of the pivot seat and also showing a hinge pin displaced away from a hinge bore defined within the contact edge of the pivot seat.

In a further aspect of the portable, collapsible ergonomic tipping chair 10, the seat hinge 36 may be made of any seat hinge means 36 for pivotally securing the pivot seat 34 to the front surface 20 of the main strut 12, such as traditional metal types of door hinges (not shown), and any known hinge that can perform the hinge functions described, etc. More specifically, the seat hinge means 36 may include at least a first coupling 62 and a second coupling 64 that are secured to and extend away from the front surface 20 of the main strut 12, wherein each coupling 62, 64 defines a coupling bore 66 (shown only in FIG. 8 for the first coupling 62) passing through the couplings 62, 64. At least a first notch 68 and a second notch 70 (shown in FIGS. 2 and 9) are defined within the contact edge 58 of the pivot seat 34. The contact edge 58 is opposed to the leading edge 54, and is positioned adjacent the front surface 20 of the main strut 12 when the tipping chair 10 is in the FIG. 1 seated configuration. The at least first and second notches 68, 70 are configured to receive the first and second couplings 62, 64 (as shown in FIG. 2) within the notches 68, 70. A hinge bore 72 is defined to pass through the contact edge 58 of the pivot seat 34 and through the first and second notches 68, 70. A hinge pin 74 is configured to pass through the hinge bore 72, to pass through the first and second notches 68, 70 and the first and second coupling bores (only the first coupling bore 66 is shown in FIG. 8) of the first and second couplings 62, 64 within the first and second notches 68, 70 to thereby pivotally secure the pivot seat 34 to the front surface 20 of the main strut 12.

In an additional embodiment of the portable, collapsible ergonomic tipping chair 10, a distance between the pivot strut axle 30 (shown in FIG. 4) and the seat end 26 of the pivot strut 24 is between about sixty percent and about seventy percent of a distance between the pivot strut axle 30 and the prop end 28 of the pivot strut 24.

In a further aspect of the disclosure, the tipping chair includes friction enhancing means 76 secured to the bottom end 14 of the main strut 12 for increasing friction between the bottom end 14 and the chair support surface 44 upon which the tipping chair is supported. In particular embodiments, the friction enhancing means include friction enhancing members 78 secured to the bottom end 14 of the main strut 12 and configured to contact the surface 44 upon which the tipping chair 10 is supported. The friction enhancing members 78 may be selected from the group consisting of rubber, compounds including rubber, polymers, engineered polymers, asbestos containing and non-asbestos containing friction materials, organic friction based compounds, and combinations thereof.

Figure 10:
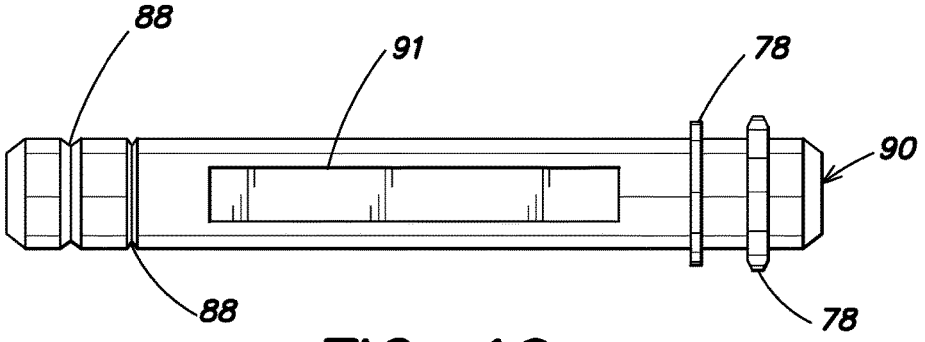
FIG. 10 is a top plan view of a foot configured to be secured to a bottom end of a main strut of a portable, collapsible ergonomic tipping chair and showing friction-enhancing "O-rings" secured on a side of the foot, and showing grooves defined in an opposed side of the foot.

FIGS. 1-4 show that the portable, collapsible ergonomic tipping chair 10 includes at the bottom end 14 of the main strut 12 a foot 80 secured to the bottom end 14 of the main strut 12. The foot 80 extends beyond at least one of a first side edge 82 and a second side edge 84 of the main strut 12. Also, the foot 80 is positioned to contact the support surface 44 upon which the tipping chair 10 is supported, and the foot 80 defines at least a partial cylindrical outer surface 86 contacting the surface 44 upon which the tipping chair 10 is supported. The at least partial cylindrical shape 86 facilitates tipping of the chair 10. The foot 80 may also include at least one friction enhancing member 78 secured between the cylindrical outer surface 86 and the surface 44 upon which the tipping chair 10 is supported. FIG. 10, for example, shows a flexible O-ring 78 as a friction enhancing member in an alternative foot 90 that also shows circumferential grooves 88 defined on one side of the alternative foot 90 to secure the O-rings 78 on the foot 90. FIG. 10 also shows a bottom end receiving slot 91 defined within the alternative foot 90 for securing the bottom end 14 to the alternative foot 90.

In another aspect of the portable, collapsible ergonomic tipping chair 10, the chair 10 includes the latch 42 as a latch means 42 on the brace surface 40 of the pivot seat 34 for engaging and disengaging the seat end 26 of the pivot strut 24 from the latch means 42. The latch means 42 may be any latch 42 commonly known that can detachably secure a support strut 24 to a flat surface 40, such as a metal hook (not shown) on the brace surface 40 and a metal eye-loop (not shown) on the seat end 26 of the pivot strut 24, a "hook-and-loop" (known commonly as "VELCRO") pad (not shown) on the brace surface 40 and a cooperative hook-and-loop extension (not shown) from the seat end 26 dimensioned to contact the pad (not shown) to secure the seat and 26 to the latch 42, etc.

FIG. 6 shows the pivot strut 24 having its seat end 26 and opposed prop end 28 isolated from the chair 10. It can be seen that one embodiment of the latch means 42 includes the seat end 26 of the pivot strut 24 having a slotted birds-mouth tip 92. Corresponding with this embodiment of the latch means 42, the latch 42 includes a latch lip 94 (shown only in FIG. 5) and a latch bore 96 extending from the latch lip 94 under the brace surface 40 in a direction away from the brace surface 40 of the pivot seat 34. The slotted birds-mouth tip 92 is configured so that the tip 92 engages the latch lip 94, and an upper portion 98 of the birds-mouth tip 92 passes into the latch bore 96 beyond the latch lip 94. A lower portion 100 of the birds-mouth tip 92 extends beyond the latch lip 94 toward the leading edge 54 of the pivot seat 34. Therefore a force applied to the seating surface 38 of the pivot seat 34 in a direction perpendicular to the seating surface 38 and toward the bottom end 14 of the main strut 12 locks the slotted birds-mouth tip 92 between the latch lip 94 and the latch bore 96. Also, an opposed force applied to the brace surface 40 in a direction away from the bottom end 14 of the main strut 12 pivots the pivot seat 34 away from the seat and 26 of the pivot strut 24 thereby unlocking the slotted birds-mouth tip 92 of the seat end 26 of the pivot strut 24 from the latch 42.

Figure 12:
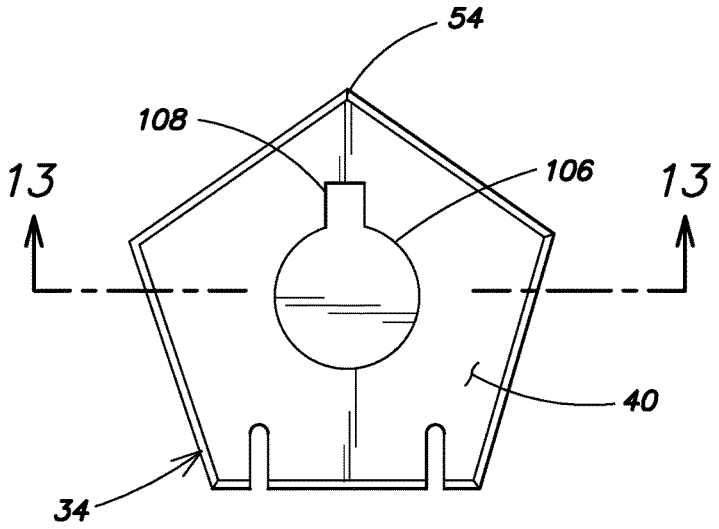
FIG. 12 is a bottom plan view of a brace surface of a pivot seat of a portable, collapsible ergonomic tipping chair and showing latch bore of a dovetail latch and showing a mortise cavity extending under the brace surface from the latch bore in a direction toward a leading edge of the pivot seat.
Figure 13:
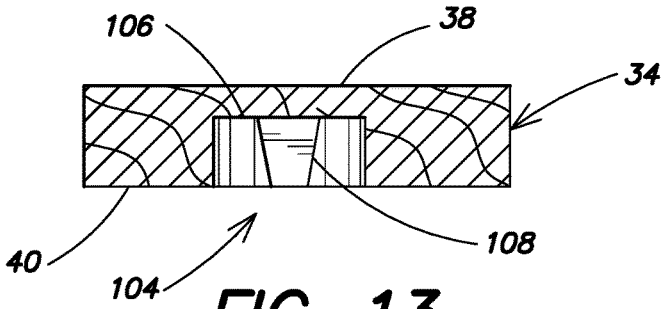
FIG. 13 is a cross-sectional view taken along the lines 13-13 of FIG. 12 showing the mortise cavity.
Figure 14:
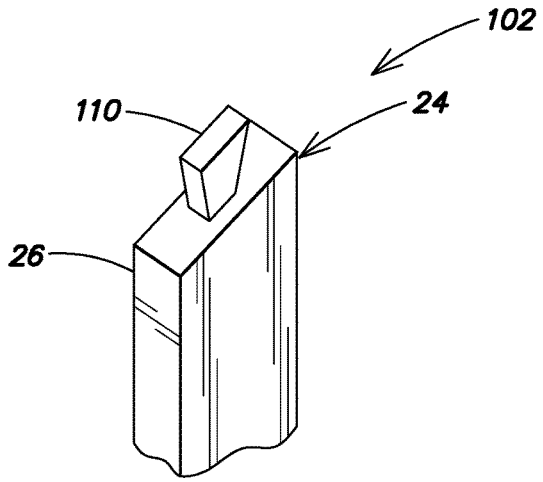
FIG. 14 is a top perspective view of a seat end of a pivot strut of a portable, collapsible ergonomic tipping chair showing a tenon projection configured to slide into the mortise cavity of FIG. 13.

FIGS. 12, 13 and 14 show a further aspect of the latch means 42 at the brace surface 40 of the pivot chair 10. FIG. 12 shows the pivot seat 34 isolated from the chair; FIG. 13 shows a cross-sectional view of the pivot seat 34 taken along view lines 13-13 of FIG. 12 and rotated so that the brace surface 40 is under the seating surface 38; and FIG. 14 shows a section of dovetail-modified seat end 102 of the pivot strut 24. The FIGS. 12, 13 and 14 embodiment of the latch means 42 is a dovetail latch 104 that includes a latch bore 106 extending under the brace surface 40 and includes a mortise cavity 108 extending under the brace surface 40 from the latch bore 106 in a direction toward the leading edge 54 of the pivot seat 34. Additionally the dovetail latch 104 includes the seat end 26 of the pivot strut 24 having a tenon projection 110 configured so that the tenon projection 110 slides into the mortise cavity 108 to secure the seat end 26 of the pivot strut 24 against removal from the dovetail latch 104 by a force on the pivot seat 34 in the direction toward the top end 16 of the main strut 24.

Figure 11:
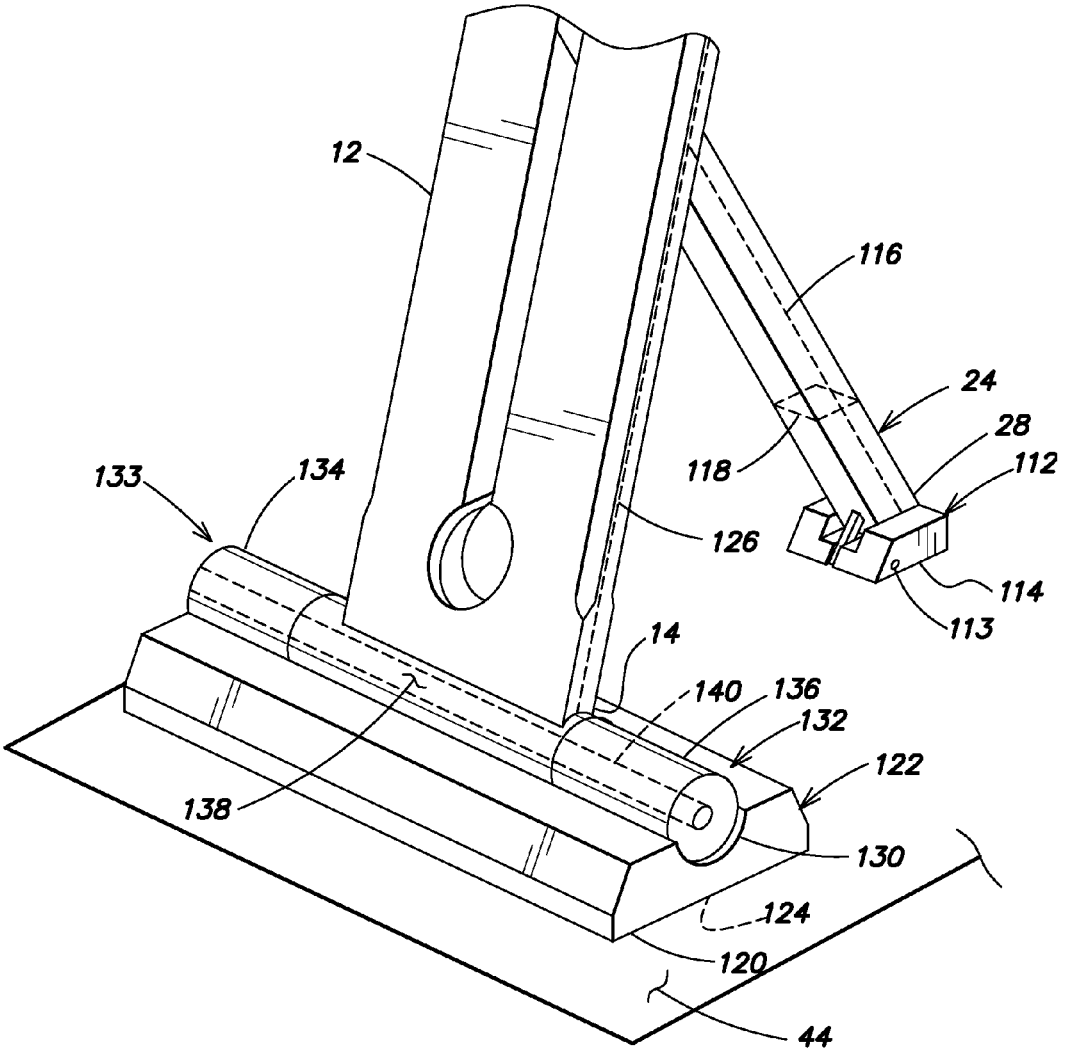
FIG. 11 is a sectional view of a main strut of a portable, collapsible ergonomic tipping chair and showing an expansion pivot foot secured to a bottom end of the main strut and showing an expansion shoe secured to a prop end of a pivot strut.

FIG. 11 shows another embodiment of the tipping chair 10 wherein the prop end 28 of the pivot strut 24 includes an expansion shoe 112 pivotally secured by a pivot axle 113 to the prop end 28, wherein the pivot axle 113 passes through the expansion shoe 112 and the prop end 28. The expansion shoe 112 is configured for contacting the support surface 44 upon which the tipping chair 10 is supported. The expansion shoe 112 defines a cross-sectional surface area 114 parallel to a plane perpendicular to a longitudinal axis 116 of the pivot strut 24 that is at least between about one hundred percent and about three hundred percent greater than a cross-sectional surface area 118 of the pivot strut 24. The pivot strut cross-sectional 118 area is parallel to a plane perpendicular to the longitudinal axis 116 of the pivot strut 24. Whenever the tipping chair 10 is positioned in the FIGS. 2 and 3 stored configuration, the pivot strut 24 is aligned within the pivot slot 18 to be flush within the slot 18, while the expansion shoe 112 pivots away from the pivot slot to be adjacent the back surface 22 of the main strut 12.

FIG. 11 also shows an expansion pivot foot 120 secured to the bottom end 14 of the main strut 12 for contacting the support surface 44 upon which the tipping chair 10 is supported. The expansion pivot foot 120 includes a base 122 defining a contact surface area 124 parallel to a plane perpendicular to a longitudinal axis 126 of the main strut 12 that is at least between about three hundred percent and about six hundred percent greater than a cross-sectional surface area 128 (shown only in FIG. 4) of the bottom end 14 of the main strut 12. The cross-sectional area 128 of the bottom end 14 of the main strut is parallel to a plane perpendicular to the longitudinal axis 126 (shown in FIG. 11) of the main strut 12. The expansion pivot foot 120 defines a pivot trough 130 above the base 122, and the trough 130 includes a pivot dowel 132 pivotally secured within the pivot trough 130 and secured to the bottom end 14 of the main strut 12. This permits pivoting of the main strut 12 while the base 122 remains stationery relative to the support surface 44 upon which the tipping chair is supported. Optionally, the pivot dowel 132 may be a three-piece dowel 133, with a first outer dowel 134 and an opposed second outer dowel 136 secured firmly within the pivot trough 130 so that they can be neither removed nor pivoted. An inner dowel 138 is firmly secured to the bottom and 14 of the main strut 12, and is pivotally secured within the pivot trough 130 by an expansion pivot foot axle 140 passing axially through the entire three-piece dowel 133 to thereby secure the inner dowel 138 to the outer dowels 134, 136, while permitting pivoting of the inner dowel 138.

FIG. 7 shows an alternative main strut 12' having a first receiving slot 142 and a second receiving slot 144 on the front surface 20' of the main strut 12', wherein the receiving slots 142, 144 are configured to receive and secure a hinge coupling, such as the first hinge coupling 62 shown in FIG. 8. Rather than using an unattractive metal hinge (not shown) for the seat hinge means 36, the FIGS. 7 and 8 embodiments show an attractive wooden coupling that may be inserted into the receiving slots 142, 144 to make a strong and attractive seat hinge 36. FIG. 7 also shows a relative position of the pivot strut axle 30 between the receiving slots 142, 144 of the seat hinge 36 and the bottom end 14' of the alternative main strut 12'.

Figure 16:
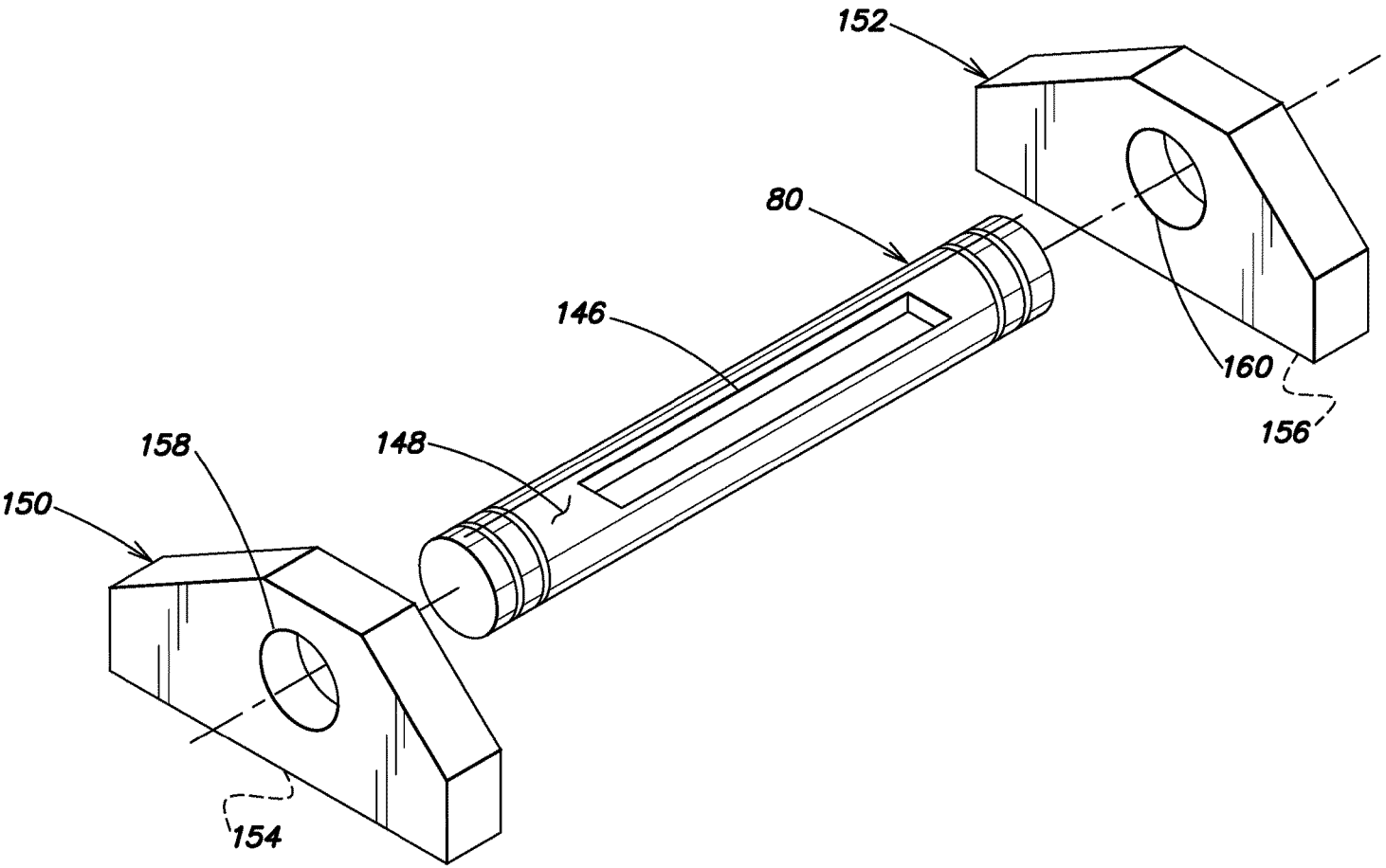
FIG. 16 is a raised perspective view of a foot dimensioned to be secured to a bottom end of a main strut of a portable, collapsible ergonomic tipping chair and showing a first detachable expansion shoe detached from the foot and showing a second detachable expansion shoe pivotally secured to the foot.

FIG. 16 shows the foot 80 removed from the FIGS. 1-4 tipping chair 10, revealing a receiving slot 146 defined within the foot for receiving the bottom end 14 of the main strut 12. The foot 80 extends beyond at least one of opposed side edges 82, 84 of the bottom end 14 of the main strut 12. The foot 80 is positioned to contact the support surface 44 upon which the tipping chair 10 is supported. The foot 80 defines at least a partial cylindrical outer surface 148 contacting the support surface 44 upon which the tipping chair 10 is supported to facilitate tipping of the chair 10. The foot 80 also includes at least one detachable expansion shoe, such as a first detachable expansion shoe 150 and/or a second detachable expansion shoe 152. The expansion shoes 150, 152 have a first base 154 and/or a second base 156 defining a surface area parallel to a plane perpendicular to the longitudinal axis 126 of the main strut 12 that is at least between about one hundred percent and about three hundred percent greater than the partial cylindrical outer surface area 148 of the foot 80 contacting the support surface 44. The first and second detachable expansion shoes 150 and 152 define a first pivot bore 158 and a second pivot bore 160 configured for being pivotally secured to opposed cylindrical ends of the foot 80.

FIG. 1 also shows that the main strut 12 of the tipping chair 10 defines one or a plurality of wall-mount throughbores 162 passing through an upper portion 164 of the main strut 12. Additionally, the opposed side-edges 82, 84 of the main strut 12, as shown in FIGS. 1-4, may define curved edges, or curved edges with straight edges, wherein the opposed side-edges are configured in mirror-image association with each other, as shown in FIGS. 1-4, for an attractive aesthetic appearance of the chair 10. Use of several of the tipping chairs (not shown) that are in the FIGS. 2 and 3 stored configuration supported by wall mounts (not shown) passing through the wall-mount throughbores 162 provides a unique form of wall art, wherein the tipping chairs 10 have the same or differing (not shown) curved, mirror-image side edges, and wherein the tipping chairs are made of wood exhibiting attractive grain and color patterns. For example, in a very small room (not shown), several of the tipping chairs (not shown) may be attractively stored by their wall-mount throughbores 162 flat against a wall or walls (not shown) of the room. Only a desired number of the chairs would be repositioned to their FIGS. 1 and 4 seating configurations to suit the number of persons in the room (not shown). The tipping chairs 10 can then be re-positioned back into their FIGS. 2 and 3 stored configurations and replaced onto the wall (not shown) after use to efficiently and attractively manage the room.

As shown in FIGS. 1-4, the pivot slot 18 of the main strut 12 defines a first finger-grasp throughbore 166 at an end of the slot 18 nearest the bottom and 14 of the main strut. The finger-grasp throughbore 166 extends beyond the seat end 26 of the pivot strut 24. A second finger-grasp throughbore 168 is defined at an opposed end of the slot 18 nearest the top end 16 of the main strut 12, and the second finger-grasp slot extends beyond the prop end 28 of the pivot strut 24. The finger-grasp throughbores 166, 168 define voids facilitating movement of the pivot strut 24 out of and into the pivot slot.

Figure 15:
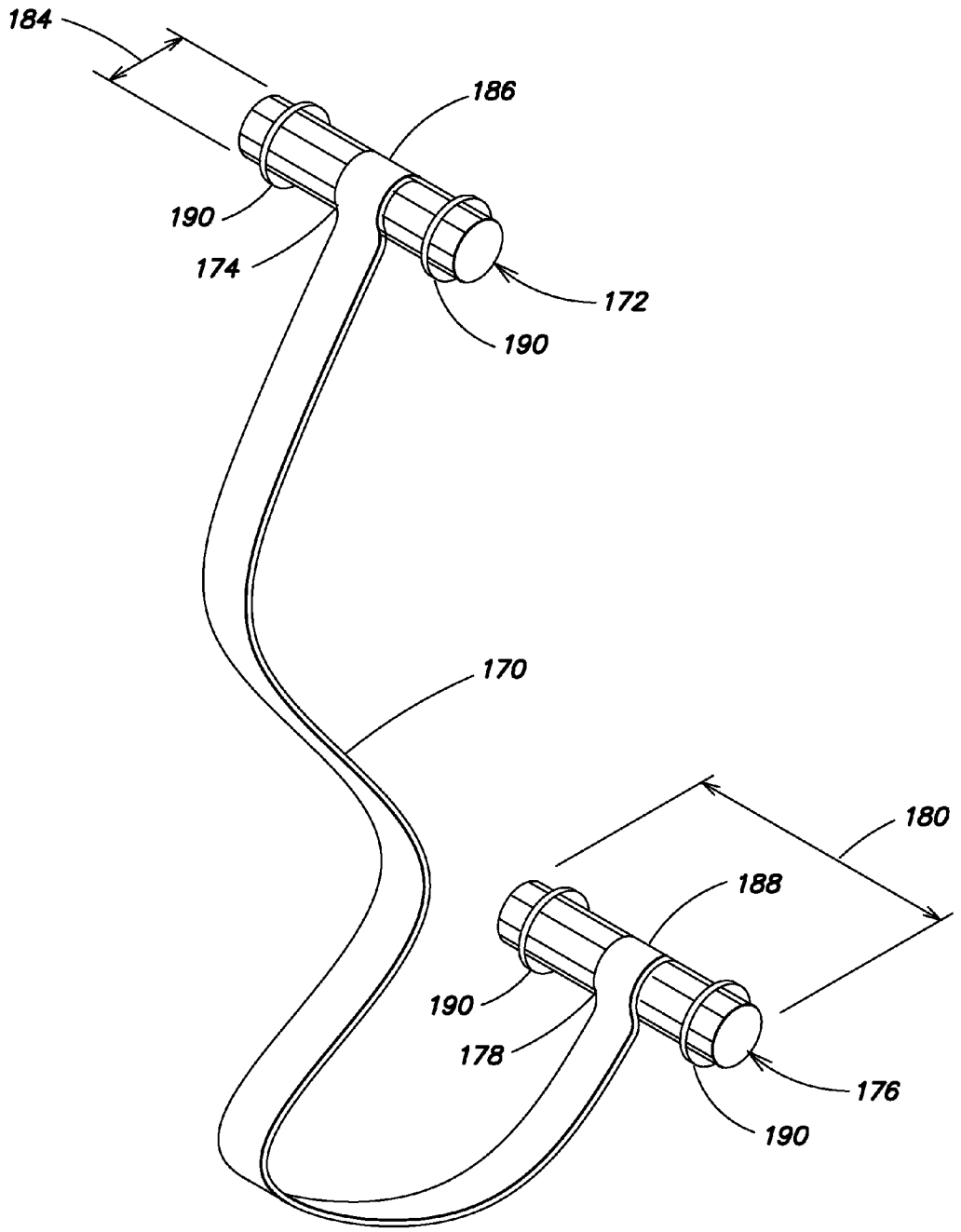
FIG. 15 is a top perspective view of a flexible carrying strap for carrying a portable, collapsible ergonomic tipping chair and showing dowel segments at opposed ends of the strap.

FIG. 15 shows that the tipping chair 10 of FIGS. 1-4 may further include a flexible carrying strap 170 having a first dowel segment 172 at a first end 174 of the strap 170 and a second dowel segment 176 at an opposed second end 178 of the strap 170. The first and second dowel segments 172, 176 are dimensioned to have axial lengths 180 longer than longest diameters 182 (shown only in FIG. 2) of the finger-grasp throughbores 166, 168. The first and second dowel segments 172, 176 are also dimensioned to have diameters 184 shorter than the longest diameters 182 of the finger-grasp throughbores 166, 168. Additionally, the first and of the strap 174 is secured to a mid-section 186 of the first dowel segment 172 and the second end 178 of the strap is secured to a mid-section 188 of the second dowel segment 176.

For efficient portability of the tipping chair 10, the relative dimensions of the first and second dowel segments 172, 176 permit the dowel segments 172, 176 to be moved longitudinally through the first and second finger-grasp throughbores 166, 168. Upon application of a lifting force on the strap 170 and with the strap ends being positioned in the mid-sections 186, 188 of the dowel segments 172, 176, the dowel segments move to be positioned perpendicular to the diameters 182 of finger-grasp throughbores 166, 168 and the dowel segments 172, 176 extend beyond the finger-grasp throughbores 166, 168 to rest against the front or back surface 20, 22 of the main strut 12 outside of the finger-grasp throughbores 166, 168. In this disposition of the dowel segments 172, 176, the strap 170 may be used to support the tipping chair 10 in the FIGS. 2 and 3 stored configuration, such as over a shoulder of a user (not shown), until the user (not shown) rotates the dowel segments 172, 176 to pass them through the finger-grasp throughbores 166, 168 to thereby remove the carrying strap 170 from the tipping chair 10. The dowel segments 172, 176 may also include rubber-like O-rings 190 around distal ends of the dowel segments 172, 176 to enhance friction between the dowel segments 172, 176 and the front or back surface 20, 22 of the main strut 12, and to avoid scratching or other damage to the front or back surfaces 20, 22.

Figure 3:
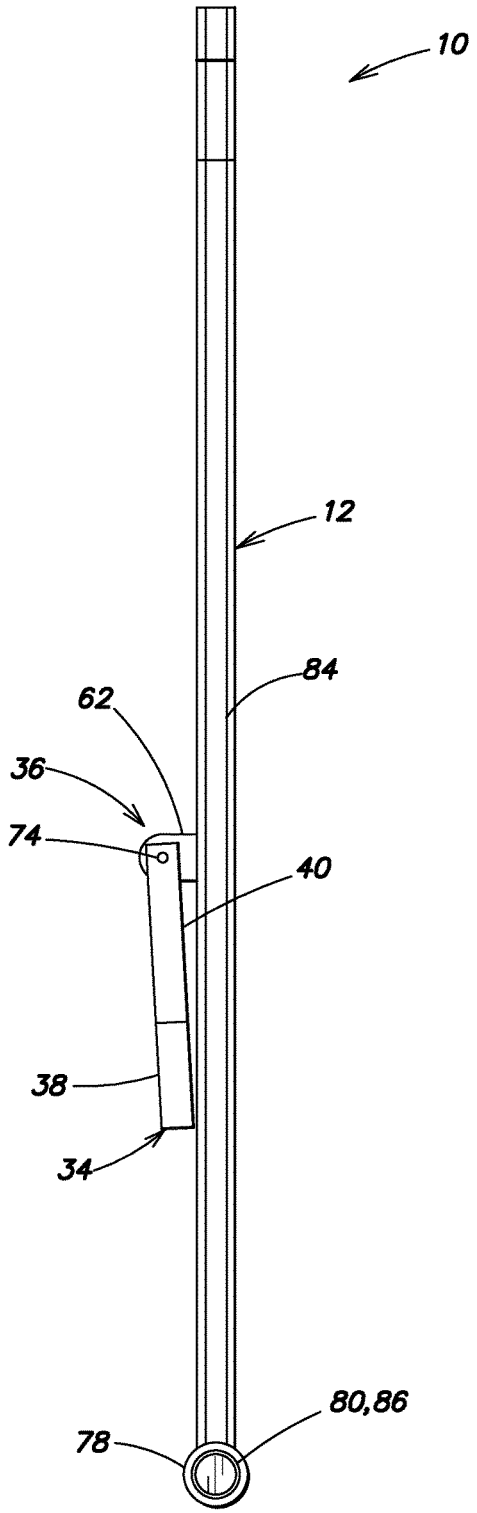
FIG. 3 is a side plan view of the FIG. 2 portable, collapsible ergonomic tipping chair in the stored configuration.
Figure 4:
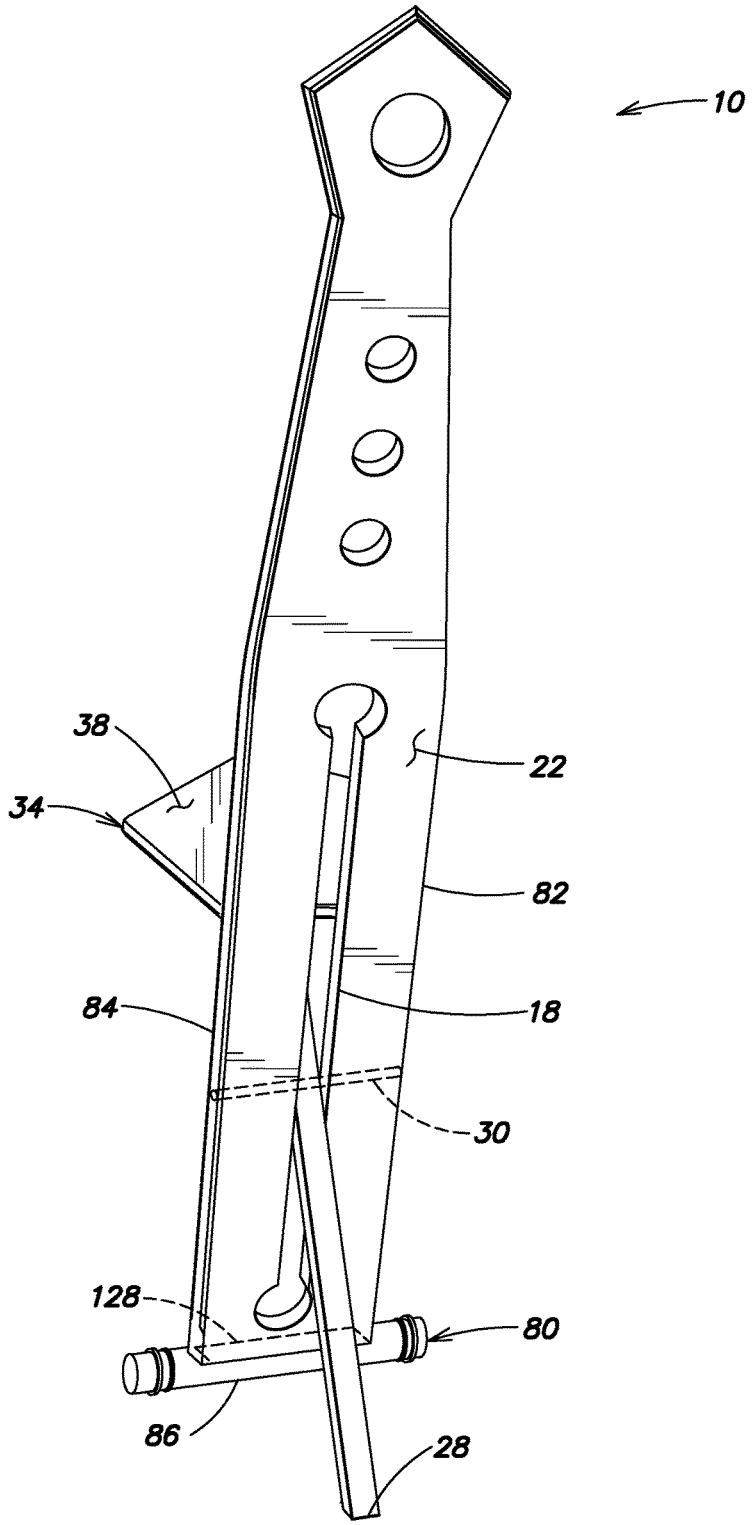
FIG. 4 is a rear side perspective view of the FIG. 1 portable, collapsible ergonomic tipping chair in the seating configuration.
Figure 5:
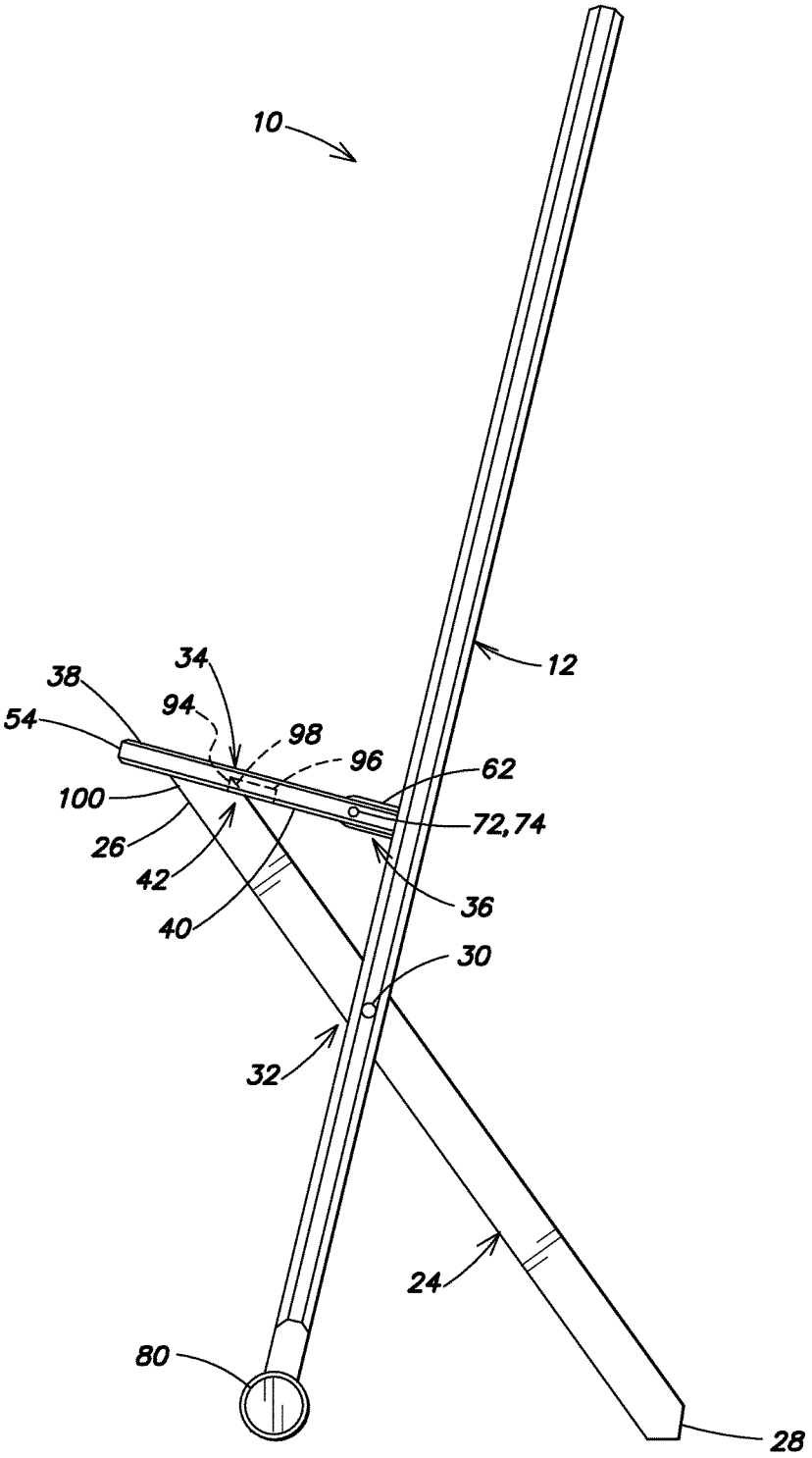
FIG. 5 is a side plan view of the portable, collapsible ergonomic tipping chair of FIG. 1 and showing a latch in a brace surface of a pivot seat of the tipping chair.

It is to be understood that the present disclosure also includes an inventive method of transitioning the portable, collapsible ergonomic tipping chair 10 from the FIGS. 2 and 3 stored configuration to the FIGS. 1 and 4 seating configuration. The method includes pivoting the prop end 28 of the pivot strut 24 away from the back surface 22 of the main strut 12 while simultaneously pivoting the seat end 26 of the pivot strut 24 away from the front surface 20 of the main strut 12; raising the leading edge 54 of the pivot seat 34 away from adjacent the front surface 20 of the main strut 12 by the pivoting of the seat end 26 of the pivot strut 24 so that the seat end 26 of the pivot strut 24 contacts and raises the leading edge 54 of the pivot seat 34 to align the seating surface 38 of the pivot seat 34 to be about perpendicular to the front surface 20 of the main strut 12; moving the seat end 26 of the pivot strut 24 along the brace surface 40 of the pivot seat 34 from the leading edge 54 toward the contact edge 58 of the pivot seat 34; positioning the prop end 28 of the pivot strut 24 so that a first distance 46 between the bottom end 14 of the main strut contacting the chair support surface 44 and the prop end 28 contacting the chair support surface 44 is dimensioned so that the main strut 12 is in a main strut seated alignment 48 between the back surface 22 of the main strut 12 and the prop end 28 of the pivot strut 24 contacting the chair support surface 44 that is between about sixty-five degrees and about eighty-five degrees; and securing the seat end 26 of the pivot strut 24 to the latch 42 on the brace surface 40 of the pivot seat 34 to secure the tipping chair 10 in the FIGS. 1 and 4 seated configuration.

An additional method of using the tipping chair 10 includes transitioning the chair 10 from the FIGS. 1 and 4 seated configuration to the FIGS. 2 and 3 stored configuration, by removing the seat end 26 of the pivot strut 24 from the latch 42; then pivoting the seat end 26 of the pivot strut 24 toward the bottom end 14 of the main strut 12 and into the pivot slot 18; and permitting the leading edge 54 of the pivot seat 34 to pivot toward the bottom end 14 of and front surface 20 of the main strut 12 until the brace surface 40 of the pivot seat 34 is aligned adjacent the front surface 20 of the main strut 12 near the bottom end 14 of the main strut 12 to thereby secure the tipping chair 10 in the FIGS. 2 and 3 stored configuration.

In a preferred construction, the portable, collapsible ergonomic tipping chair 10 is manufactured so that visible surfaces are made of varying types of wood to provide an attractive appearance. The pivot strut axle 30, hinge pin 74, the expansion shoe axle 113, and the expansion pivot foot axle 140 are preferably made of metal. It has been described above that an optimal main strut seated alignment 48 between the back surface 22 of the main strut 12 and the prop end 28 of the pivot strut 24 contacting the chair support surface 44 is optimally between about sixty-five degrees and about eighty-five degrees. These dimensions provide for the FIGS. 1 and 4 seated configuration to provide a comfortable seating arrangement for average sized persons. However, the length of the prop end 28 of the pivot strut 24 extending from the pivot strut axle 30 may be lengthened or shortened to custom-fit the tipping chair 10 to accommodate varying sized individuals. This is a benefit of manufacture of the chair 10 in wood that would not be achieved through typical, folding-chair mass-produced metal fabrication processes.

For average-sized persons, optimal dimensions of the components of the tipping chair 10 are: main strut 12 about forty inches long and about five inches wide; pivot seat 34 of hardwood about nine inches by nine inches and arranged in a "diamond" disposition relative to the main strut 12, so the underside of users legs (not shown) are on straight seat edges, as shown in FIGS. 1-4; pivot strut 24 about twenty-one inches; and, the foot 80 at the bottom end 14 of the main strut 12, about ten inches long.

As can be readily appreciated, the tipping chair 10 provides a truly remarkable combination of active seating, efficient storage, and optionally storage as wall art because of its unique juxtaposition of essentially flat wood-products in an extraordinarily clever combination.

While the present disclosure has been presented above with respect to the described and illustrated embodiments of the portable, collapsible ergonomic tipping chair 10, it is to be understood that the disclosure is not to be limited to those alternatives and described embodiments. For example, the tipping chair 10 may be constructed of any materials that would perform the described functions, such as metals, plastics, resins, etc. Accordingly, reference should be made primarily to the following claims rather than the forgoing description to determine the scope of the disclosure.

What is claimed is:

1. A portable, collapsible ergonomic tipping chair that enables a user of the chair to gently exercise their leg and abdominal muscles by tipping the chair while seated in the chair, the chair comprising:

a. a main strut having a bottom end and an opposed top end, the main strut defining a pivot slot extending from adjacent the bottom end toward the top end, and an entire length of the pivot slot passing completely through the main strut from a front surface through a back surface of the main strut;

b. a pivot strut including a seat end and an opposed prop end, the pivot strut being pivotally secured within the pivot slot by a pivot strut axle that is secured between the main strut and a mid-section of the pivot strut so that the pivot strut axle enables the pivot strut to pivot back-and forth from a first position wherein the pivot strut is completely within pivot slot and the seat end of the pivot strut is adjacent the bottom end of the main strut to a second position wherein the seat end of the pivot strut extends away from the front surface of the main strut and the prop end of the pivot strut extends away from the back surface of the main strut;

c. a pivot seat pivotally secured to the main strut by a seat hinge, the pivot seat having a seating surface and an opposed brace surface, the brace surface Including a latch for engaging and disengaging the seat end of the pivot strut from the latch, wherein the seat hinge is positioned between the pivot strut axle and the top end of the main strut, so that the seat hinge enables the pivot seat to pivot back-and-forth from first position wherein the brace surface is aligned adjacent the front surface of the main strut to a second position wherein the brace surface of the pivot seat is aligned about perpendicular to the front surface of the main strut;

d. wherein, whenever the pivot strut is in the first position and the brace surface of the pivot seat aligned adjacent the front surface of the main strut, the tipping chair is in a stored configuration; and, e. wherein whenever the pivot strut is in the second position so that the seat end of the pivot strut is pivoted out of the pivot slot to contact and position the brace surface of the pivot seat about perpendicular to the front surface of the main strut, to position the seat end of the pivot strut detachably secured to the latch in the brace surface of the pivot seat, and to position the prop end of the pivot strut away from the back surface of the main strut, the tipping chair is in seating configuration.

2. The portable, collapsible ergonomic tipping chair of claim 1, wherein, whenever the chair is in the seating configuration so that the prop end of the pivot strut and the bottom end of the main strut are contacting a chair support surface upon which the tipping chair is supported and the chair support surface is about parallel to a plane perpendicular to a direction of the force of gravity:

a. a distance between the bottom end of the main strut contacting the chair support surface and the prop end of the pivot strut contacting the chair support surface is dimensioned so that the main strut is in a main strut seated alignment between the back surface of the main strut and the prop end of the pivot strut contacting the chair support surface, wherein the main strut seated alignment is between about sixty-five degrees and about eight five degrees;

b. the pivot sear is supported by the seat end of the pivot strut so that the pivot seat is in a seated pivot seat alignment betreen about eighty-five degrees and about one-hundred degrees between the seating surface of the pivot seat and a portion of the front surface of the main strut above the seat hinge, wherein "above" is in a direction toward the top end of the main strut; and, c. leading edge of the pivot seat extends a distance away from the front surface of the main strut that is about one-half of a distance between the seat hinge and the bottom end of the main strut contacting the chair support surface, the tipping chair thereby being configured to impose a slouch-proof correct seated posture on a user seated on the seating surface of the pivot seat and with the user's back leaning against the front surface of the main strut.

3. The portable, collapsible ergonomic tipping chair of claim 1, further comprising a seat hinge means for pivotally securing the pivot seat to the front surface of the main strut.

4. The portable, collapsible ergonomic tipping chair of claim 3, wherein the seat hinge means comprises a first coupling and a second coupling secured to and extending away from the front surface main strut, a first notch and a second notch defined within a contact edge of the pivot seat and configured to receive the first and second couplings, a hinge bore passing through the contact edge of the pivot seat and through the first and second notches, and a hinge pin configured to pass through the hinge bore, the first and second notches and the first and second couplings respectively within the first and second notches to pivotally secure the pivot seat to the front surface of the main strut.

5. The portable collapsible ergonomic tipping chair of claim l, wherein a distance between the pivot strut axle and the seat end of the pivot strut is between about 60 percent and about 70 percent of a distance between the pivot strut axle and the prop end of the pivot strut.

6. The portable, collapsable ergonomic tipping chair of claim 1, further comprising friction enhancing means or increasing friction between the bottom end of the main strut and a surface upon which the tipping chair is supported.

7. The portable, collapsable ergonomic tipping chair of claim 6, wherein the friction enhancing mean include friction enhancing members secured to the bottom end of the main strut and configured to contact the surface upon which the tipping chair is supported, the friction enhancing members being selected from the group consisting of rubber, compounds including rubber engineered polyaers, asbestos containing and non-asbestos containing friction material organic friction base compounds, and combintions thereof.

8. The portable, collapsable ergonomic tipping chair of claim 6, wherein the friction enhancing means includes a foot secured to the bottom end of the main strut, wherein the foot extends beyond at least one of opposed side edges of the bottom end of the main strut, wherein the foot is positioned to contact the surface upon which the tipping chair is supported, wherein the foot defines at least a partial cylindrical outer surface contacting the surface upon which the tipping chair is supported to facilitate tipping of the chair, and wherein the foot includes a friction enhancing member secured between the cylindrical outer surface and the surface upon which the tipping chair is supported.

9. The portable, collapsible ergonomic tipping chair of claim 8, wherein the friction enhancing member includes a flexible O-ring secured within cylindrical grooves defined in an outer circumference of the foot.

10. The portable, collapsible ergonomic tipping chair of claim 1, further comprising a latch means on the brace surface of the pivot seat for engaging and disengaging the seat end of the pivot strut from the latch.

11. The portable, collapsible ergonomic tipping chair of claim 10, wherein the latch means on the brace surface of the pivot seat further comprises a latch lip and latch bore extending from the latch lip under the brace surface in a direction away from the brace surface of the pivot seat, wherein the seat end of the pivot strut defines a slotted bird's-mouth tip configured so that the slot of the slotted bird's-mouth tip engages the latch lip, an upper portion of the slotted bird's-mouth tip passes into the latch bore beyond the latch lip and a lower portion of the slotted bird's-mouth tip extends beyond the latch, lip, toward a leading edge of the pivot seat, so that a force applied to the seating surface of the pivot seat and in a direction perpendicular to seating surface and toward the bottom end of the main strut locks the slotted bird's-mouth tip between the latch lip and the latch bore, and so that an opposed force applied to the brace surface in a direction away from the bottom end of the main strut pivots the pivot seat away from the seat end of the pivot strut thereby unlocking the slotted birds-mouth tip of the seat end of the pivot strut from the latch.

12. The portable, collapsible ergonomic tipping chair of claim 10, wherein the latch means on the brace surface of the pivot seat further comprises a dovetail latch that includes a latch bore extending under the brace surface and includes a mortise cavity extending under the brace surface from the latch bore in a direction toward a leading edge of the pivot seat, wherein the seat end of the pivot strut includes a tenon projection configured so that the tenon projection slides into secure the mortise cavity to secure the seat end of the pivot strut against removal from the dovetail latch by a force on the pivot seat in a direction of the top end of the main strut.

13. The portable, collapsible ergonomic tipping chair of claim 1, wherein the prop end of the pivot strut includes an expansion shoe, for contacting a surface upon which the tipping chair is supported, the expansion shoe defining a cross-sectional surface area parallel to a plane perpendicular to a longitudinal axis of the pivot strut that is between about one hundred percent and about three hundred percent greater than a cross-sectional surface area of the pivot strut, which pivot strut cross-sectional area is parallel to a plane perpendicular to a longitudinal axis of the pivot strut, and wherein whenever the tipping chair is positioned in the stored configuration, the pivot strut is aligned within the pivot slot to be flush within the slot, while the expansion shoe pivots away from the pivot slot to be adjacent the bads surface of the main strut.

14. The portable, collapsible ergonomic tipping chair of claim 1 further comprising an expansion pivot foot secured to the bottom end of the main strut for contacting a surface upon which the tipping chair supported, the expansion pivot foot including a base defining a surface area parallel to a plane perpendicular to a longitudinal axis of the main strut that is between about three hundred percent and about six hundred percent greater than a cross-sectional surface area of the bottom end of the main strut, which bottom end of the main strut cross-sectional area is parallel to plane perpendicular to a longitudinal axis of the main strut, the expansion pivot foot defining a pivot trough above the base, and including a pivot dowel pivotally secured within the pivot trough and secured to the bottom end of the main strut to permit pivoting of the main strut while the base remains stationery relative to a surface upon which the tipping chair is supported.

15. The portable, collapsible ergonomic tipping chair of claim 1, further comprising a foot secured to the bottom end of the main strut, wherein the foot extends beyond at least one of opposed side edges of the bottom end of the main strut, wherein the foot is positioned to contact a surface upon which the tipping, chair is supported, wherein the foot defines at least a partial cylindrical outer surface contacting the surface upon which the tipping chair is supported to facilitate tipping of the chair, and wherein the foot includes a detachable expansion shoe having a base defining a surface area parallel to a plane perpendicular to a longitudinal axis of the main strut that is between about one hundred percent and about three hundred percent greater than a surface area of the portion of the partial cylindrical outer surface of the foot contacting the support surface, wherein the detachable expansion shoe defines pivot bore configured for being pivotally secured to at least one of the side edges of the foot.

16. The portable, collapsible ergonomic tipping chair of claim 1, wherein the main strut defines a wall-mount throughbore passing through an upper portion of the main strut, and wherein opposed side-edges of the main strut define at least one of curved edges, and curved edges with straight edges, wherein the opposed side-edges are configured in mirror-image association with each other.

17. The portable, collapsible ergonomic tipping chair of claim 1, wherein the pivot slot defines a first finger-grasp throughbore at a bottom end of the pivot slot, and a second finger-grasp throughbore at an opposed top end of the pivot slot, the finger-grasp throughbores defining voids facilitating movement of the pivot strut out and into the pivot slot, and the tipping chair further comprising a flexible carrying strap having a first dowel segment at a first end of the strap and a second dowel segment at an opposed second end of the strap, the first and second dowel segments being dimensioned to have, axial lengths longer than diameters of the finger-grasp throughbores, and the first and second dowel segments also dimensioned to have diameters shorter than the diameters of the finger-grasp throughbores, the first end of the strap being secured to a mid-section of the first segment and the second end the strap being secured to a mid-section of the second dowel segment.

18. A method of transitioning the portable, collapsible ergonomic tipping chair of claim 1 from the stored configuration to the seating configuration, comprising:

a. pivoting the prop end of the pivot strut away from the back surface of the main strut while simultaneously pivoting the seat end of the pivot strut away from the front surface of the main strut;

b. raising a leading edge of the pivot seat away from adjacent the front surface of the main strut by the pivoting of the seat end of the pivot strut so that the seat end of the pivot strut contacts and raises a leading edge seating surface, and aligning the seating surface of the pivot seat to the front surface of the main strut to be between about eighty degrees and about one-hundred degrees;

c. moving the seat end of the pivot strut along the brace surface of the pivot seat from the leading edge toward a contact edge of the pivot seat; and, d. then, securing the seat end of the pivot strut to the latch on the brace surface of the pivot seat to secure the tipping chair in the seated configuration.

19. The method of claim 18, further comprising transitioning the portable, collapsible ergonomic tipping chair from the seated configuration to the stored configuration, by removing the seat end of the pivot strut from the latch, then pivoting the seat end of the pivot strut toward the bottom end of the main strut and into the pivot slot, and permitting the leading edge of the pivot seat to pivot toward the front surface of the main strut until the brace surface of the pivot seat Is aligned adjacent the front surface of the main strut near the bottom end of the main strut to thereby secure the tipping chair in the stored configuration.

* * * * *